US005398388A

United States Patent [19]

Coleman

[11] Patent Number: 5,398,388

[45] Date of Patent: Mar. 21, 1995

[54] TENSIONING ASSEMBLY FOR FLEXIBLE SIGN FACES AND AWNINGS

[76] Inventor: Kelly R. Coleman, 516 Belle Isle Ave., Belleair Beach, Fla. 34635

[21] Appl. No.: 58,083

[22] Filed: May 7, 1993

[51] Int. Cl.[6] ..... A44B 11/25

[52] U.S. Cl. ..... 24/581; 24/462; 40/603

[58] Field of Search ..... 40/603, 604; 160/368.1, 160/391, 395; 24/459, 462, 581

[56] References Cited

U.S. PATENT DOCUMENTS

| | | | |
|---|---|---|---|
| 4,265,039 | 5/1981 | Brooks . | |
| 4,937,961 | 7/1990 | Gandy et al. | 40/603 |
| 4,955,928 | 9/1990 | Tanner | 40/603 |
| 5,255,459 | 10/1993 | Verret | 40/603 |

*Primary Examiner*—Brian K. Green
*Attorney, Agent, or Firm*—Edwin E. Greigg; Ronald E. Greigg

[57] ABSTRACT

Tensioning assembly mounted to or incorporated into a display device which is in the form of one or more display faces made from a substantially flexible polymer and which is mounted on a frame about its peripheral portions such that sufficient or a predetermined amount of tension is placed on the face so as to at least somewhat resemble a rigid plate or face. Tensioning devices may be attached to the face in opposed relation to one another and these tensioning devices may be in the form of a connecting unit which serves to interconnect the face to the frame while at the same time placing the desired amount of tension thereon. The display device may be interiorly lighted by providing a lighting assembly on the interior of the frame adjacent to the flexible face so as to transmit light thereto and clearly display any indicia formed on the face. The connecting unit comprises connector assemblies spaced approximately nine inches on center relative to the frame and to the display face such that the amount of tension placed on the face may be regulated by the engagement of these connector assemblies with the peripheral portion of the face around the periphery edge of the display device.

2 Claims, 5 Drawing Sheets

TENSIONING ASSEMBLY FOR FLEXIBLE SIGN FACES AND AWNINGS

DESCRIPTION OF THE PRIOR ART

This invention is an improvement over U.S. Pat. No. 3,982,345 and more particularly to a tensioning device for making a sign facing formed of a flexible material tight against a sign frame.

A display device attachment means including one or more flexible polymer display faces having tension placed thereon by virtue of a tensioning means and or connectors attaching the display face to a supporting frame wherein indicia may be formed on the display face.

In the advertising industry, the use of display devices including those being interiorly illuminated and which are either permanently or temporarily mounted at a given location are, of course, very well known in the art. The particular configuration or construction of the sign utilized in any given advertising application depends upon such things as type of business, goods, or services being advertised, location in which the sign or display device is to be located and the particular segment the public to which the advertisement is directed. Because of these many diverse applications there is of course a demand for various types of signs. This demand for such a wide variety of sign structures necessarily raises the cost of production and also that of maintenance since many of the signs utilized today have to be made by individual specifications.

Other disadvantages inherent in the production of use of custom made sign faces include the cost involved in stalling these flexible sign faces which frequently equals or exceeds the actual production cost. Since up to the present time no one single sign system has had the versatility to satisfy the wide variety of advertising needs, the installation within the varying sign structures would also have to be done on a custom installation type basis. Since a custom built application has been normally utilized and adapted to a particular location and application, worker involved in installing these custom made faces would often times be dealing with completely different types of structures of which they had no general knowledge or experience. Because of the above factors, the time and expense involved in installing these prior art sign faces is relatively great.

Large scale or mass production of a substantially standard tensioning apparatus device capable of being applied to various uses is, of course, highly desirable in that this type of manufacturing serves to lower the cost of production. Maintenance of a standard type sign will also be less expensive since repair or servicing of such a sign could be done on a replacement part basis. However, as pointed out above the diverse application for which these face frame signs are needed and used normally would prevent a sign structure from being mass produced, For this reason, mass production of a generally standard type sign, which is to be effective for various applications, has been relatively unknown in the advertising industry. In devising production methods for producing such signs, labor, production, time and necessary equipment are all prime factors. In addition, the ultimate appearance of the sign itself must always be kept in mind.

One of the most important structural features of any sign is of course, the display face used for advertising of the various services or goods. Naturally, the display face itself is what is primarily observed by the public. It can therefore be seen that the production of a display face which would be adapted to fit various sign structures and which itself is aesthetically pleasing, yet eye catching, could greatly reduce the cost of "customized" sign tensioning apparatus. Such apparatus if available, could be applied to almost any of the conventionally designed prior art structures available today.

Because of these and other commonly known problems prevalent in the advertising and sign making industry, there has been a long felt need for a tensioning apparatus incorporating a display face which is versatile enough to be adapted to a number of various advertising structures. At the same time, such a tensioning apparatus and display face structure must include a relatively simple, low cost construction capable of being easily maintained and transported to any given location. Ideally, such a sign tensioning apparatus would be of somewhat standard type construction which is capable of being built through the application of mass production techniques. In addition, the versatility of such a structure would include its being readily used for various applications while at the same time being capable of efficiently and aesthetically advertising any desired subject matter.

SUMMARY OF THE INVENTION

The present invention is directed to a sign tensioning apparatus comprising a frame means which may be interiorly lighted by virtue of any conventional lighting assembly. The lighting assembly is preferably positioned in substantially adjacent relation to the rear surface of a display face for transmitting light therethrough and rendering any indicia formed on the face readily obvious.

The face itself is formed from a substantially flexible polymer such as polyvinyl chloride (PVC) and is connected to the frame along with peripheral portions. Tensioning means are provided which may comprise the connecting means itself wherein the tensioning means are located in opposed relation to one another. While other flexible polymeric material can be utilized other than PVC, it has been found through actual application and testing, that polyvinyl chloride is well suited for the use herein described and is accordingly preferred. More specifically, when the connecting means comprises the tensioning means, the connecting means includes a plurality of connector assemblies spaced at least 9" on center around the periphery edge of the display device. The connector assemblies may be mounted in opposed relation to one another whereas in Coleman's U.S. Pat. No. 3,982,345, at least one of these two assemblies was to be rotationally mounted relative to both the frame and the peripheral portion of the face which it engages. The opposite of the connector assembly was substantially fixedly mounted to the frame so as to hold or secure the opposite periphery portion of the face in substantially a fixed position relative to the periphery portion of the frame on which it was mounted. Therefore, in this particular embodiment rotation or movement of the one connector assembly caused "rapping" of the peripheral portion which it engaged about the connector assemblies thereby serving to place tension on the face itself making it substantially rigid, since the opposite portion of the face remained stationary it was held in place by the opposite stationary connector assembly. Rigid, in the sense used herein, means substantially rigid in the sense of rigidity, normally identified with the skin or membrane used for drums or similar percussion type musical instruments.

One embodiment of the present invention comprises the display face including a single sheet dimensioned to extend across the entire display opening of the frame which is held in place by the tensioning devices.

This single sheet has its major peripheral portions attached to the peripheral portions of the frame by virtue of a number of tensioning apparatus which is the subject of this invention. When this tensioning apparatus is utilized, connector assemblies may be utilized approximately 9" on center, each of which is positioned in opposed relation to at least one other. Coleman's U.S. Pat. No. 3,982,345 sets forth the state of the art and encompassed connector assemblies of the rotational shaft type previously discussed wherein the shaft is rotatably mounted along a peripheral portion of the frame and configured to engage a peripheral portion of the display face while the opposing edge remained stationary.

This invention incorporates connector assemblies which create motion in all sides similar to the previous invention ratchet assembly, however, the ratchet effect is straight line and the tensioning is formed in all directions whereas the previous invention had one side stationary and one side movable. This invention was developed to reduce cost, increase speed and simplify the installation of flexible faces on new structures as well as on retrofit face requirements in the field to existing or old sign embodiments.

Locking means in the form of a ratchet assembly is created by the movability of the connector assembly so as to allow movement of the assembly in one direction and prevent or restrict a movement in the other direction thereby preventing the display face from becoming "unraveled" or loose. The straight line ratchet effect is formed as part of the connector assembly and may have slot means specifically attached thereto or formed thereon and configured to engage a specifically configured peripheral portion of the display face. More specifically, the display face may include a peripheral portion compromising a plurality of tongue means arranged in space relation to one another wherein each of the tongue means may be attached directly to the slot means formed on the tensioning assembly. The connector assembly may include a plurality of channels or grooves configured to have mounted therein a separated bar. The peripheral portion of the display face designed to engage this connector assembly may also include corresponding channels or grooves formed therein such that the connector assemblies may engage the fixed receiver which is an integral void or C-Channel with notches and or grooves that mate with grooves on the connector assembly to create a straight line rachet effect. To remove the tensioning apparatus, a flat tool is inserted in the rear of the tensioning clip so that the connector apparatus is engaged with counterpart grooves or teeth. Once disengaged, the connector slides free.

Another embodiment of the present invention may include the display means including a plurality of display faces arranged in side by side, adjacent relation to one another wherein opposed peripheral portions of each of the display faces are connected to the frame and are thereby tensioned to be substantially "rigid" in the sense described above. Again, the connecting means, which may form part of the tensioning means may include opposed connector assemblies wherein either or both of the connector assemblies may be movably mounted thereon such that the proper tension can be placed on the individual sheets which define the individual display faces. As in the embodiment described above, each of the individual sheets which form each of the individual display faces is produced from a substantially flexible polymer material.

The invention accordingly comprises the features of construction, combination of elements and arrangement of parts will be exemplified in the construction hereinafter set forth, and the scope of the invention will be indicated in the claims.

BRIEF DESCRIPTION OF THE DRAWINGS

For a better understanding of the nature and the objects of the invention, reference should be had to the following detailed description, taken in connection with the accompany drawing in which.

DETAILED DESCRIPTION

Figure 3:
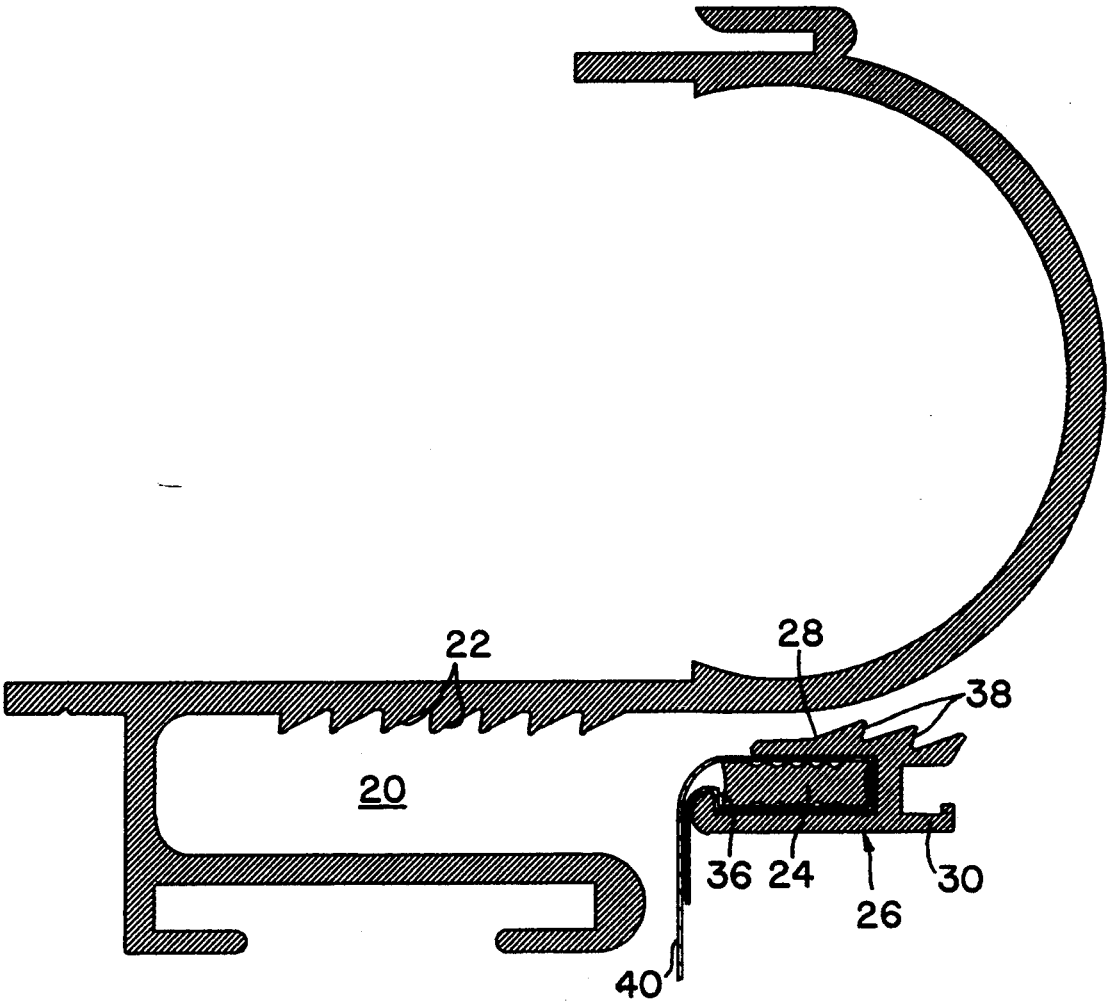
FIG. 3 illustrates the serrated wrapped bar assembled in the tension clamp shown in FIG. 1.
Figure 7:
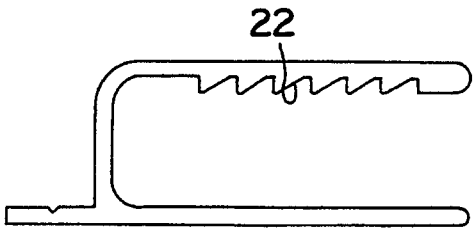
FIG. 7–14 illustrates different shaped sign channels with which the serrated bar and tension clamp can be used to tighten a flexible display cover with an end wrapped around the serrated bar.
Figure 8:
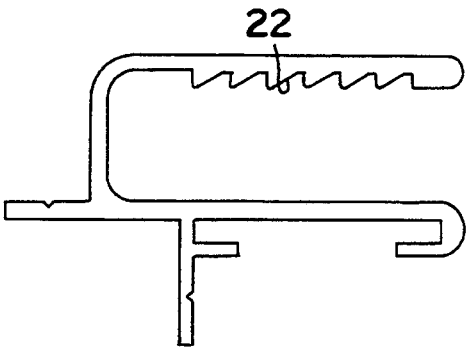
Figure 9:
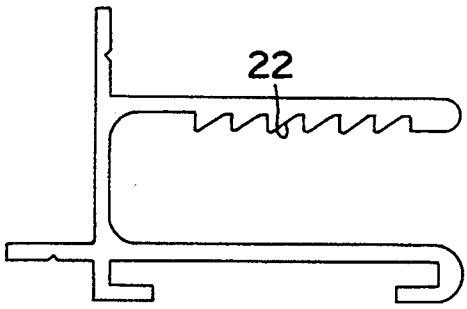
Figure 10:
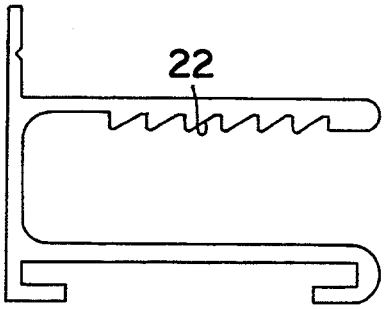
Figure 11:
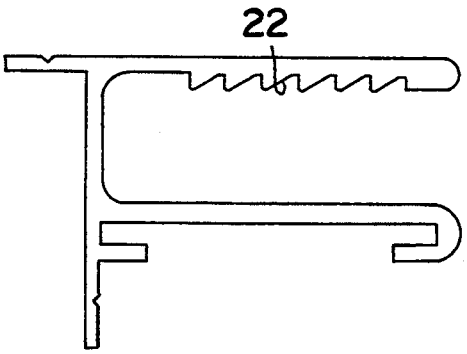
Figure 12:
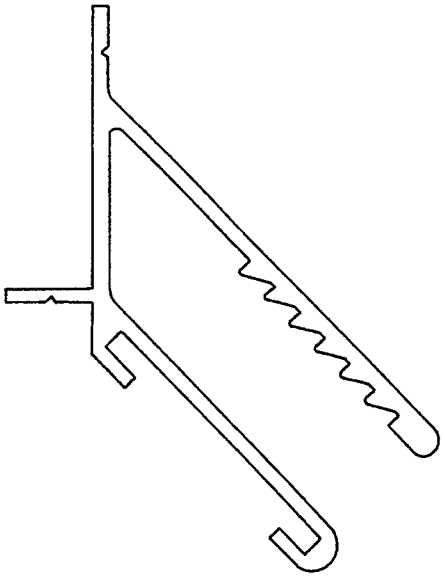
Figure 13:
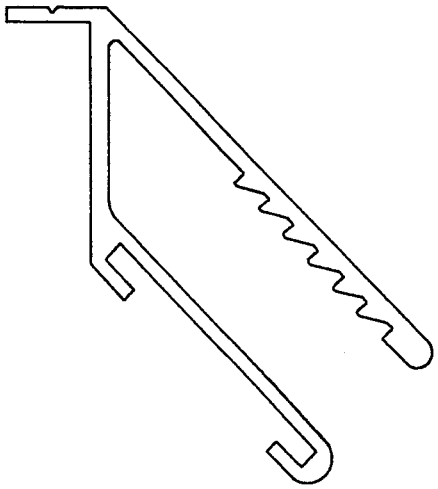
Figure 14:
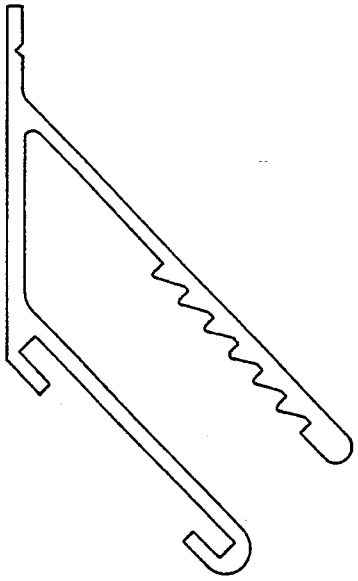

The subject of the present invention is an improvement of the rotational ratchet assembly cited in Coleman U.S. Pat. No. 3,982,345 in that a straight line ratchet is created by virtue of a formed receiver C-Channel 20 open area with grooves or teeth 22, or a channel fitted with grooves may be incorporated as part of a sign embodiment as shown in FIG. 3 or it may be provided as a part to attach to an existing sign embodiment building or other structure as depicted in FIG. 7 called a tensioning apparatus receiver. The grooves 22 in the C-Channel are angled toward the closed portion of the C-Channel.

Figure 1:
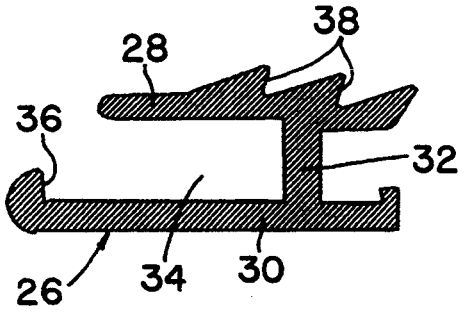
FIG. 1 illustrates a side-view of a tension clamp.
Figure 2:
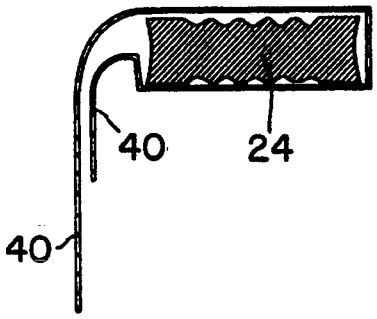
FIG. 2 illustrates an end view of a serrated bar wrapped with an end of a flexible display face.

In either event, the counterpart tensioning apparatus is made up of two parts, a serrated bar 24 which is usually extruded from aluminum and cut approximately 4" in length, FIG. 2 whereas the tensioning clamp 26 is formed with an upper arm 28 and a lower parallel arm 30 separated nearer one end by a spacer bar 32.

The spacer bar forms an elongated opening 34 which is provided with a shoulder 36 on the outer most end of the lower arm 30. The upper arm 28 is provided with grooves or teeth 38 across its length which are angled away from the opening 34. The tensioning clamp has a thickness such that the tensioning clamp will be received in the receiver C-Channel 20 such that the teeth 38 engage the teeth 22 which locks the tensioning clamp in the receiver C-Channel. In tensioning a flexible polymer display face, 40 an end portion of the display face is wrapped around the serrated bar and the wrapped serrated bar is inserted into the elongated opening 34 of the tenisoning clamp and the end of the display face is secured within the elongated opening of the tensioning clamp. The tensioning clamp is then forced into the receiver C-Channel and is locked in place by the teeth 38 on the tensioning clamp 26 engaging the teeth 22 on the receive C-Channel.

In order to tighten the entire display face, a plurality of tensioning clamps and matching serrated bars are spaced along the upper, bottom and both side edges of the display face.

FIG. 3 illustrates an end view of a sign frame with a wrapped serrated bar assembled within the open end of a tensioning clamp 26 ready to be pushed into the C-Channel 20. The serrated edge 38 of the tensioning clamp will engage the serrated edges 22 of the C-Channel and as the tensioning clamp is forced into the C-Channel, the flexible covering face will be tightened across the frame. In tightening the flexible covering oppositely disposed tensioning clamps will engage opposite C-Channel portions of the sign that is top and bottom and left side and right side. The further the tensioning clamp is forced into the channel the tighter the covering will become.

Figure 4:
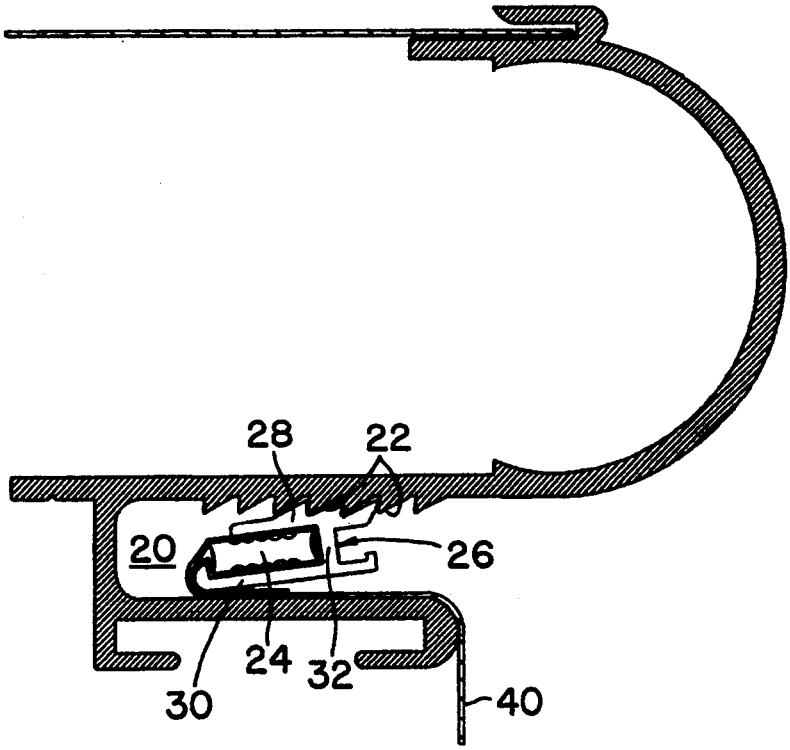
FIG. 4–6 illustrates different shaped sign frame sections in cross section with a wrapped bar and tensioning clamp shown locked in place.
Figure 5:
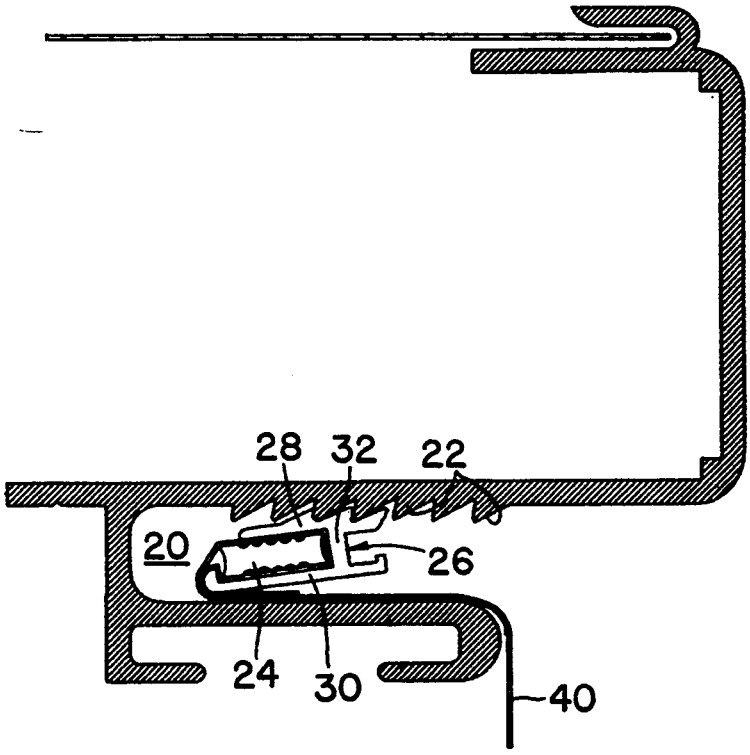
Figure 6:
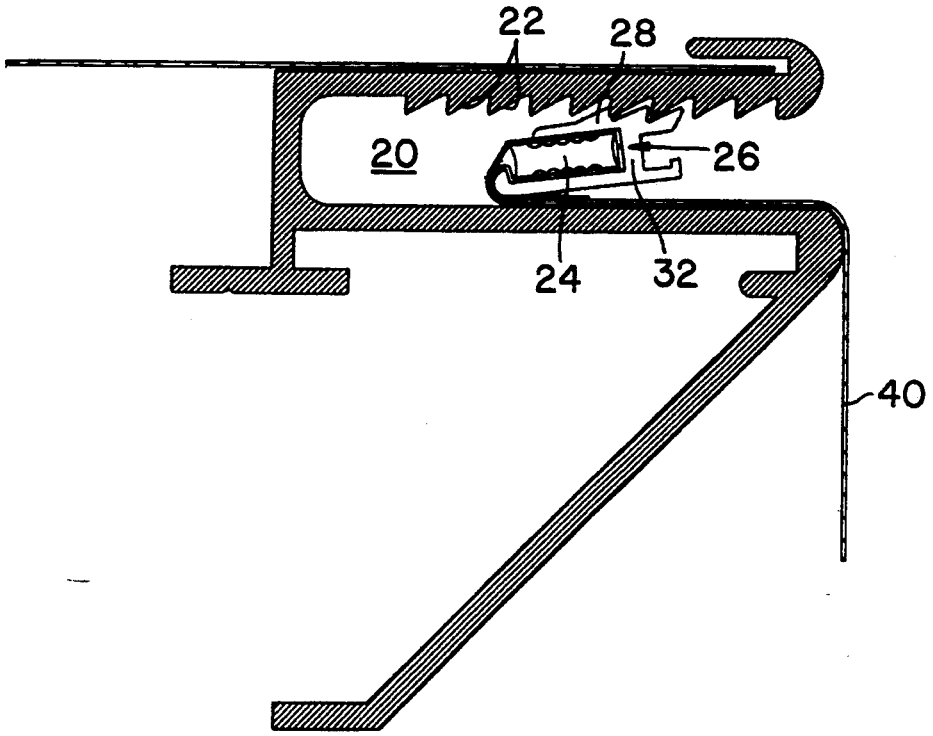

FIGS. 4–6 illustrate different shaped sign frames with serrated channels which receive the tensioning clamp loaded with the wrapped serrated bar.

FIGS. 7–14 illustrate different shaped sign frames each having a serrated channel which receives a tenisoning clamp-serrated bar combination for tightening a flexible covering of a sign.

In carrying out the invention, a sign formed by one or more frames as shown in the various drawings or an existing sign having a serrated channel is provided.

The peripheral edge of the flexible display face 40 is wrapped around the serrated bar 24 in a clockwise direction, the tension clamp 26 is pushed over the flexible substrate approximately 1" away from the point that the periphery edge of the flexible face is wrapped around the serrated bar 24.

The tensioning clamp 26 is then pushed sideways toward and over the flexible face wrapped around the serrated bar 24 to the central most point. The tensioning clamp 26 should be cut approximately 1½" in length. The tensioning assembly is now ready for insertion within a tensioning receiver depicted by the several serrated channels.

The completed assembly is positioned toward the tensioning receiver channels so that the grooves face the same direction and also face each other. The connector assembly is slid into the tensioning receiver channel until the assembly engages the first groove.

All connector assemblies on all sides of the display devices are assembled to engage the first groove, then systematically one begins to push the tensioning assemblies inwards one groove at a time around the peripheral edge until such time that the entire display face becomes appropriately tensioned. Extra tension may be achieved with the use of a flat bar or specialized tool placed against the rear of the tensioning clamp and struck with a hammer or mallet.

Removal of the tensioning assembly is achieved by inserting a bar or specialized tool into the rear of the tensioning clamp pushing it down away from the grooves to disengage the ratchet. Once disengaged, the elastic action of the tensioned face allows the assembly to pop out.

As the assembly slides in and tension is felt, the assembly rotates into position so that the grooves meet, interact and form a straight line ratchet. Similarly, with the engagement of the grooves, the tensioning action causes the tensioning clamp assembly to rotate downward away from the grooves so that the tensioning clamp presses against the wrapped flexible face and locks it against the bottom portion of the receiver.

As tension is increased, the lock action becomes greater. The greater the force created by the insertion of the tensioning assembly, the greater the lock action and the tighter the face becomes tensioned.

What is claimed and desired to be secured by Letters Patents of the United States is:

1. A tensioning receiver in combination with a tensioning apparatus for tightening a flexible display facing for a sign, said tensioning receiver comprising:

a receiver C-channel (20) having upper and lower parallel arms which extend to a closed end portion of the C-channel, said upper arm includes serrated edges, said edges face in a direction of the closed end portion of the C-channel;

said tensioning apparatus comprising: a tensioning means having generally an H-shape with spaced first and second sides separated by a spacer, said spaced first and second sides form first and second clip end openings on opposite ends of said spacer, said first clip end opening includes a shoulder on an end of said second side that extends in a direction generally toward said first side to form said first clip end opening, said first side of said tensioning means includes grooves in an outer face surface opposite said first and second clip end openings in which said grooves are angled away from said first clip end opening in said tensioning means, an elongated bar having at least one serrated face, said elongated bar is adapted for being enclosed by a portion of one end of said flexible display facing, said elongated bar inserted into said first clip end opening of said tensioning means;

and said tensioning means and said elongated bar are inserted into said C-channel of said tensioning receiver in which said grooves on said first side of said tensioning means interfit with corresponding serrated edges on said upper arm of said C-channel that are angled to mate with said grooves on said tensioning means.

2. The tensioning receiver in combination with the tensioning apparatus as set forth in claim 1, in which said grooves on said tensioning means and on said tensioning receiver are angled at opposite angles from each other.

* * * * *

UNITED STATES PATENT AND TRADEMARK OFFICE

CERTIFICATE OF CORRECTION

PATENT NO. : 5,398,388

DATED : March 21, 1995

INVENTOR(S) : KELLY R. COLEMAN

It is certified that error appears in the above-identified patent and that said Letters Patent is hereby corrected as shown below:

Column 1, lines 32-35:

--Other disadvantages inherent in the production or use of custom made sign faces include the cost involved in installing these flexible sign faces which frequently equals or exceeds the actual production cost.--

Signed and Sealed this

Eighteenth Day of July, 1995

*Attest:*

Bruce Lehman

BRUCE LEHMAN

*Attesting Officer*

*Commissioner of Patents and Trademarks*